US006446352B2

(12) United States Patent
Middelkoop et al.

(10) Patent No.: US 6,446,352 B2
(45) Date of Patent: Sep. 10, 2002

(54) CRATE DRYER

(75) Inventors: Gerrit Middelkoop, Ln Strijen; Johannes C. Andeweg, Se Numansdorp, both of (NL)

(73) Assignee: Systemate Group, B.V., Numanscorp (NL)

( * ) Notice: Subject to any disclaimer, the term of this patent is extended or adjusted under 35 U.S.C. 154(b) by 0 days.

(21) Appl. No.: 09/805,270

(22) Filed: Mar. 13, 2001

(30) Foreign Application Priority Data

Mar. 15, 2000 (NL) ..... 1014651

(51) Int. Cl.[7] ..... F26B 17/30

(52) U.S. Cl. ..... 34/58; 34/58; 217/5; 217/36; 217/122

(58) Field of Search ..... 34/58, 60, 202, 34/204; 217/36, 122, 5

(56) References Cited

U.S. PATENT DOCUMENTS 1,542,929 A 6/1925 Woolrich et al.
1,599,557 A 9/1926 Craig
1,756,281 A 4/1930 Cherrington
5,675,905 A * 10/1997 Hougham ..... 34/58
5,802,733 A * 9/1998 Hougham ..... 34/58
5,992,042 A * 11/1999 Mitchell et al. ..... 34/319
6,053,351 A * 4/2000 Dunton et al. ..... 220/636
6,112,429 A * 9/2000 Mitchell et al. ..... 34/312

FOREIGN PATENT DOCUMENTS

CH 230766 4/1944
DE 198 33 416 A1 1/1900
DE 41 40 989 A1 7/1992

OTHER PUBLICATIONS

European Patent Office Search Report for European Patent Application No. 01200940.3–2301 dated Aug. 10, 2001.

* cited by examiner

*Primary Examiner*—Pamela Wilson
(74) *Attorney, Agent, or Firm*—Thomas, Kayden, Horstemeyer & Risley

(57) ABSTRACT

Device for drying washed and rinsed crates or cases, comprising a frame and receiving or accommodation spaces carried by the frame for the crates or cases, in which the accommodation spaces are attached to a rotating shaft and are situated on either side of it in a symmetrical manner, and furthermore comprising means for rotating the rotating shaft and thus the accommodation spaces in order to cast off the water present on the crates or cases from them through centrifugal forces.

16 Claims, 3 Drawing Sheets

CRATE DRYER

FIELD OF THE INVENTION

The invention relates to a device for drying washed and rinsed crates or cases.

DESCRIPTION OF THE RELATED ART

Crates and cases are used by the wholesaler, auction hall, factory and the like for containing and transporting all sorts of products. After the products have been sold at the retailer's the crates are returned. The crates are then washed in order to be used again.

In the course of time the wish arose to have disposal of not only cleansed, but also dry crates. To that end various dryers have been thought up, such as compressed-air-operated blowers. A drawback of this however is that for a quick treatment of the crates to be dried a lot of so-called flat-airblasting nozzles are necessary and therefore a lot of (expensive) compressed air.

Alternatively high-pressure fans are also used, which however requires a high power, otherwise the drying capacity is to limited.

Shake devices are also used, but still quite a lot of attached water is left behind on the crates.

Crates are also dried with the help of hot air, in connection with fans. The crates are often made of synthetic material, as a result of which they do not absorb heat very well and the drying process takes quite a long time.

Another alternative is drying crates with the help of infrared radiation, but here again there is the drawback that the crates are made of synthetic material and therefore do not conduct heat very well.

Finally the drying of crates under vacuum is mentioned. The advantage of this is that a lower temperature can be worked with, but a drawback is that special —and therefore expensive—measures have to be taken in order to realise a vacuum surrounding.

SUMMARY OF THE INVENTION

It is an object of the invention to improve on this. To that end the invention provides a device for drying washed and rinsed crates or cases, comprising a frame and receiving or accommodation spaces carried by the frame for the crates or cases, in which the accommodation spaces are attached to a rotating shaft and are situated on either side of it in a symmetrical manner, and furthermore comprising means for rotating the rotating shaft and thus the accommodation spaces in order to cast off the water present on the crates or cases from them through centrifugal forces.

By using centrifugal forces the crates can be dried quickly with simple equipment. It is noted here that it is known per se to rotate crates quickly in order to dry them, but a vertical stack of crates is then rotated about the stack axis, during which imbalance may occur and the centrifugal forces often turn out to be insufficient.

Preferably the rotating shaft is horizontally positioned. This facilitates connection to supply and discharge devices for the crates to and out of the drying device, respectively, preferably parallel to its rotating shaft.

Preferably the accommodation spaces have boundaries that are adjustable in distance one to the other, so that a positive placement in the accommodation spaces can be realised for either various heights or widths between sets of crates.

The crates are kept in their places in a simple manner when the boundaries of the accommodation spaces comprise angle sections destined for engaging about the longitudinal edges of the crates.

Preferably the device is furthermore provided with a screen stationary with the frame for radially outward stopping of the water cast off from the crates, and with a collection tray for water intercepted by the screen.

From another aspect the invention provides an assembly of a device according to the invention and a supply device for crates to be dried and/or discharge device for dried crates, in which either the supply device or discharge device is in line with or can be brought in line with at least one accommodation space.

BRIEF DESCRIPTION OF THE DRAWINGS

The invention will be elucidated on the basis of the exemplary embodiment shown in the attached figures, in which.

DETAILED DESCRIPTION OF THE DRAWINGS

Figure 1:
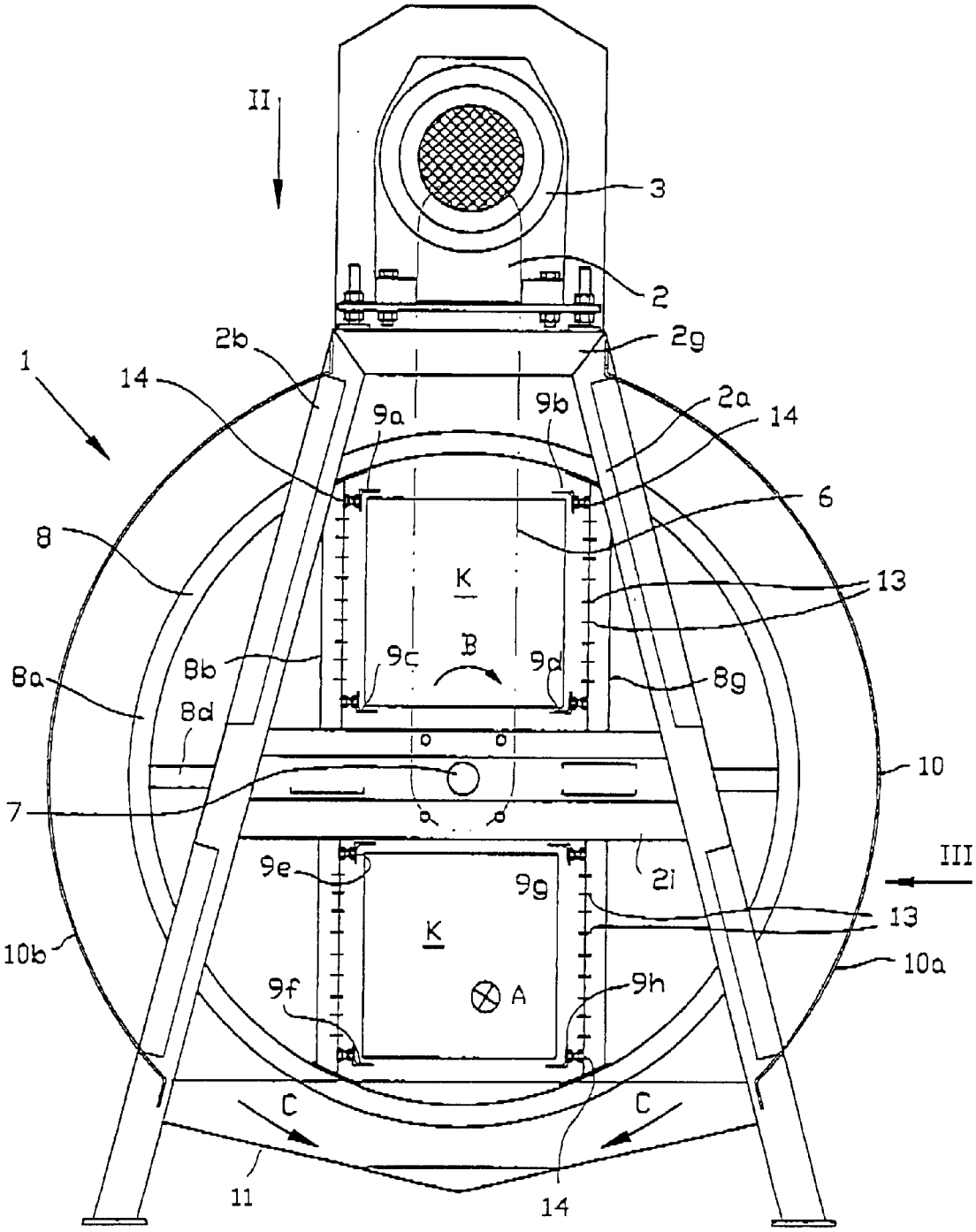
FIG. 1 shows a front view on a crate dryer according to the invention.
Figure 2:
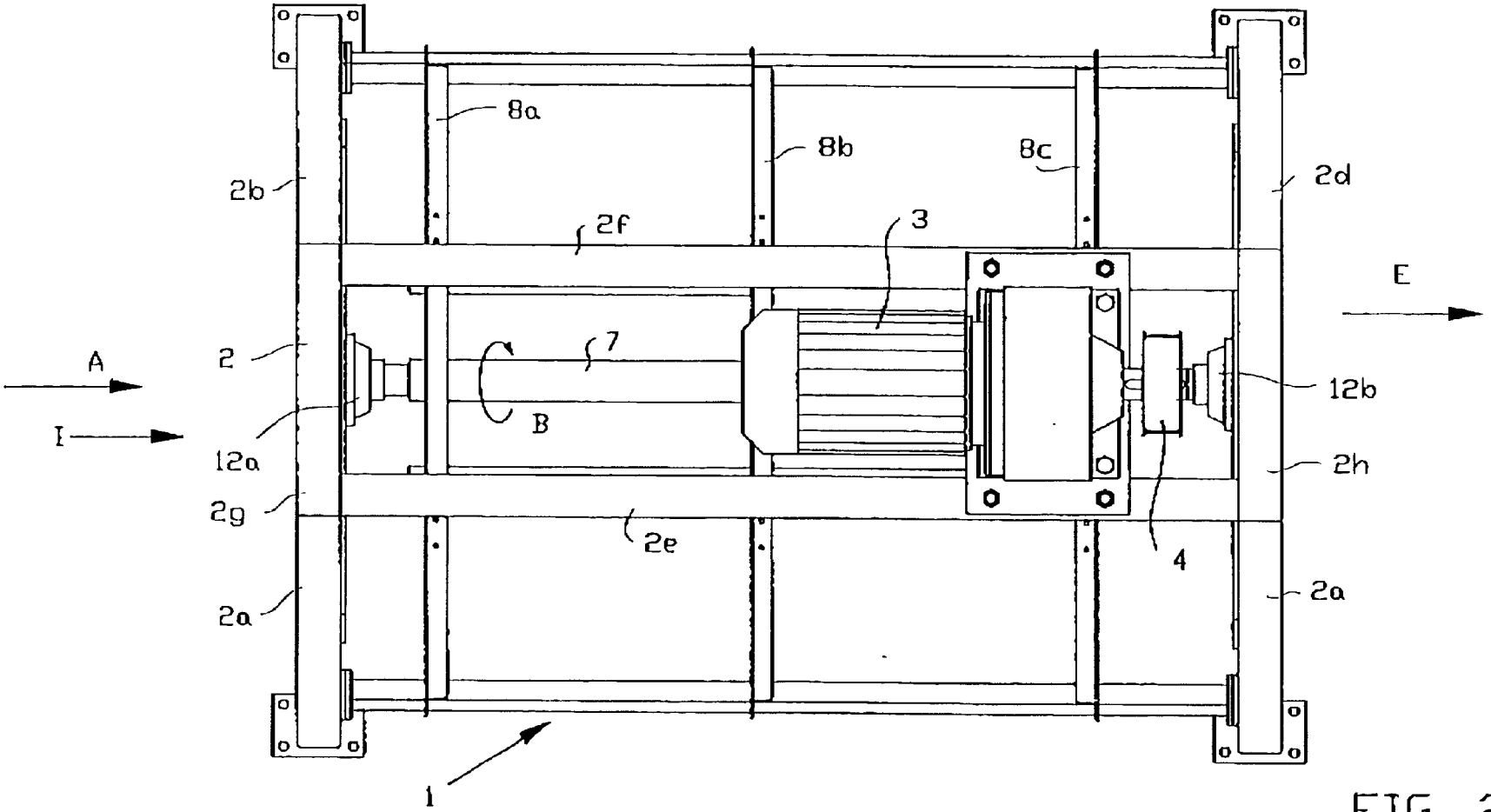
FIG. 2 shows a top view on the crate dryer of FIG. 1.
Figure 3:
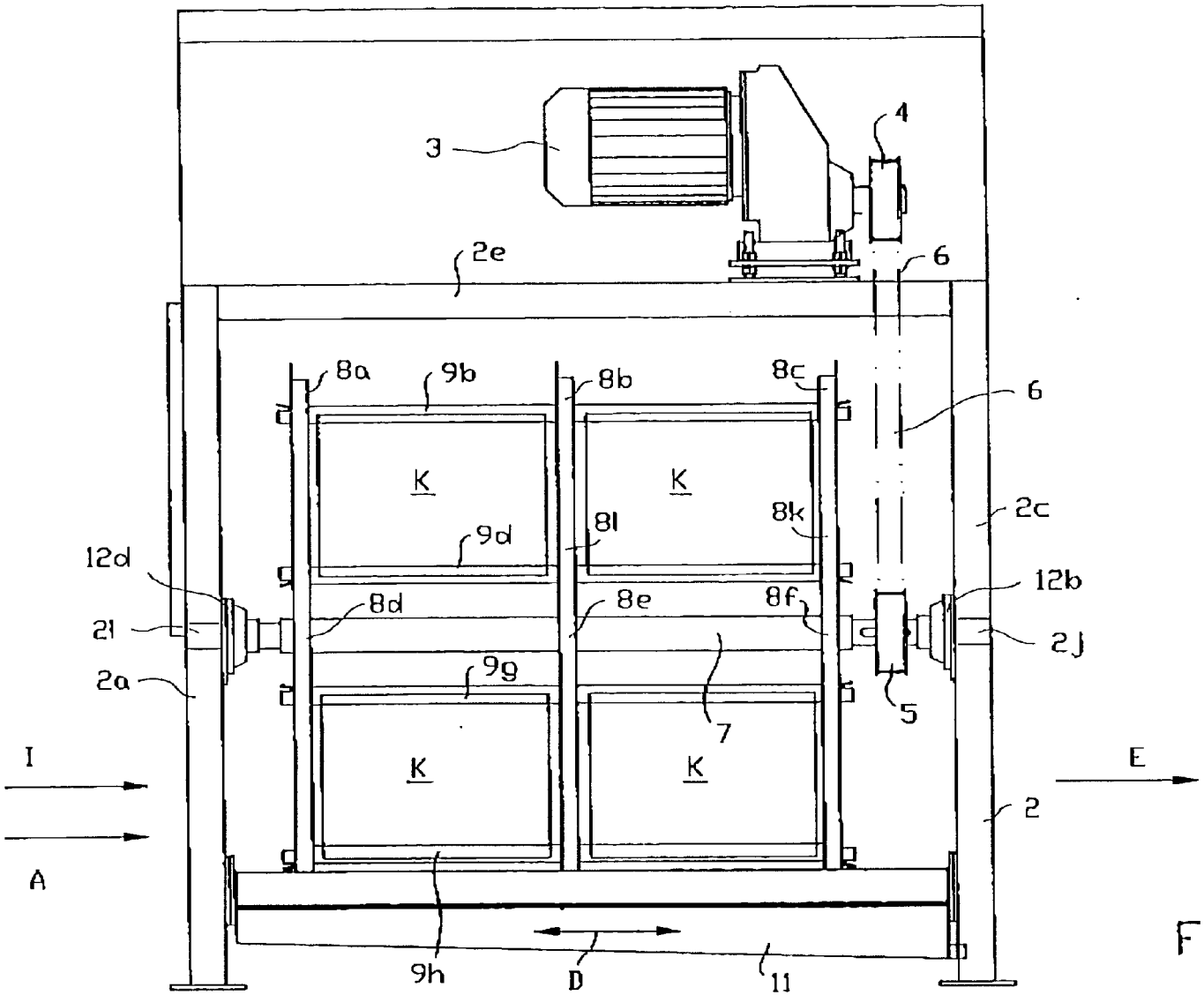
FIG. 3 shows a side view on the crate dryer of FIG. 1 and 2.

The crate dryer 1 of the FIGS. 1–3 comprises a frame 2, which at the front and at the rear comprises substantially A-shaped upright frames, having braces 2*a,* 2*b* and 2*c,* 2*d,* respectively, upper transverse beams 2*g* and 2*h,* respectively, and middle transverse beams 2*i* and 2*j* (not directly shown), respectively.

On top of the frame 2 an electric motor 3 has been mounted, with which a toothed belt pulley 4 is driven, over which toothed belt pulley 4 a toothed belt 6 runs which makes the toothed belt pulley 5 that is situated below rotate. The toothed belt pulley 5 is situated at the end of a rotating shaft 7, which on both sides is journalled in bearings 12*a,* 12*b* that are attached to the middle transverse beams 2I and 2J of the frame 2.

The rotating shaft 7 is attached to a drum 8, which is formed by an open frame, comprising a front ring 8*a,* a middle ring 8*b,* and a rear ring 8*c.* For each ring 8*a*–8*c* a transverse beam 8*d* is provided, with which the ring is attached to the rotating shaft 7. Furthermore posts 8*g,* 8*h,* 8*i,* 8*j* and 8*k,* 8*l* that are also connected to the rings 8*a*–8*c,* have each time been arranged in pairs extending upward and downward from the transverse rods 8*d,* 8*e,* 8*f.*

The posts 8*g*–8*l* are provided with holes 13, in which bolt connections 14 may extend, with which bolt connections 14 angle sections 9*a*–9*h* can be attached to the posts 8*g*–8*l,* at the wanted level.

Said wanted level depends on the height of the crates K that have to be dried in the device 1.

Around the drum 8 a screen 10 has been arranged, of which the circular shells 10*a,* 10*b* can clearly be seen in FIG. 1. Below the drum a drip tray 11 is situated, on which the water can run off in the direction C in transverse direction and subsequently in the direction D in longitudinal direction, to a location of discharge that is not further shown.

When washed, crates have to be dried. They are supplied in the direction A with means that are not shown to the drying device, and they are inserted into the bottom compartment, in FIG. 1 formed by angle sections 9*e*–9*h*. In this example two crates, one after another, can be inserted. The angle sections 9*e*–9*h* here engage about the longitudinal edges of the crate K. Subsequently the drum 8 is rotated over 180°, in order to bring the other compartments in front of the supply of crates. Two crates—in this example—are then inserted into it again, which crates then are kept confined by the angle sections 9*a*–9*d*. The drum, loaded with crates entirely on either side of the rotating shaft 7, is then balanced. The drum is subsequently rotated with such speed that the centrifugal force is sufficient to throw the water off from the crates. As soon as this speed is reached, the drum is slowed down again. As soon as the drum has come to a standstill again, the centrifuged crates are moved out of the drum, in the direction E (see FIG. 2). As a result emptying the compartments can take place simultaneously with filling the same compartments, from the direction A. As a result operation time is saved.

It will be understood that the capacity of the drum may be increased by making it longer and/or larger in diameter.

Another option is placing several drying devices 1 adjacent to each other and having them alternatingly operative such that one device is loaded/unloaded and other is rotated.

Although a preferred embodiment of the invention has been disclosed in detail herein, it will be obvious to those skilled in the art that variations and modifications of the disclosed embodiment can be made without departing from the spirit and scope of the invention as set forth in the following claims.

What is claimed is:

1. Device for drying wet crates, comprising:

a frame defining crate receiving compartments carried by the frame for receiving wet crates, said compartments being mounted in said frame for revolving about a horizontal shaft and said compartments being situated about said shaft in a symmetrical manner, means for rotating said compartments about said shaft in order to cast off the water present on the crates through centrifugal forces;

wherein the receiving compartments each comprise:

a crate entrance opening that opens parallel to said shaft and provides a passage for a crate from the outside of the device to the compartments;

a crate exit opening that opens parallel to said shaft and provides a passage for a crate from the compartments to the outside of the device; and wherein the crate entrance opening and the crate exit opening are aligned with each other on one side of the shaft.

2. Device according to claim 1, in which the receiving compartments have boundaries that are adjustably mounted in said frame so as to be positioned at various distances from each other to vary the height of the compartments.

3. Device according to claim 2, in which the boundaries of the receiving compartments comprise angle sections destined for engaging about the longitudinal edges of the crates.

4. Device according to claim 1, provided with a screen stationary with the frame for radially outward stopping of the water cast off from the crates.

5. Device according to claim 4, provided with a collection tray for water intercepted by the screen.

6. A device for drying wet crates comprising:

a support frame, a horizontally extending shaft mounted on said support frame, a drum mounted on and rotatable about said shaft, said drum defining an array of crate-receiving compartments symmetrically spaced about said rotary shaft and sized and shaped to carry crates, a motor mounted on said support frame for rotating said drum on said shaft for casting water outwardly from the crates in said compartments in response to centrifugal forces applied to the water when said drum is rotated, said compartments having first and second opposed open ends facing parallel to said shaft for receiving crates through said first open end and discharging crates through said second open end, said first open end and said second open end being aligned with each other on one side of the shaft;

a screen surrounding said drum for receiving water cast outwardly from said crates, and a collection tray positioned adjacent said screen for collecting water draining from said screen.

7. The device recited in claim 6, further comprising means for securing a crate in each compartment.

8. The device recited in claim 7, wherein the securing means further comprises:

a plurality of transverse beams secured to the shaft;

each transverse beam supporting a ring that rotates concentrically with the shaft;

a pair of posts extending across parallel chords of each ring; and a plurality of angle sections, extending parallel to the shaft between corresponding posts in different rings, for receiving longitudinal corners of the crates.

9. The device recited in claim 8, further comprising means for releasably securing the angle sections to the posts at a plurality of locations on each post.

10. The device recited in claim 9 wherein means for releasably securing the angle sections comprises a plurality of evenly-spaced holes in each post.

11. A device for drying wet crates comprising:

a shaft;

a support frame for rotatably supporting the shaft;

a plurality of transverse beams secured to the shaft;

each transverse beam supporting a ring that rotates concentrically with the shaft;

a pair of posts extending across parallel chords of each ring;

a plurality of angle sections, extending parallel to the shaft between corresponding posts in different rings, for receiving longitudinal corners of the crates; and a screen, surrounding the rings, for receiving fluid cast outwardly from crates that are received in the angle sections.

12. The device recited in claim 11, further comprising means for releasably securing the angle sections to the posts at a plurality of locations on each post.

13. The device recited in claim 12 wherein means for releasably securing the angle sections comprises a plurality of evenly-spaced holes in each post.

14. The device recited in claim 12 wherein the frame further comprises:

an entrance opening arranged at one end of the shaft;

an exit opening arranged at another end of the shaft; and wherein the crate entrance opening and the crate exit opening are aligned with each other on one side of the shaft.

15. The device recited in claim 13 wherein the frame further comprises:

an entrance opening arranged at one end of the shaft;

an exit opening arranged at another end of the shaft; and wherein the crate entrance opening and the crate exit opening are aligned with each other on one side of the shaft.

16. The device recited in claim 11 wherein the frame further comprises:

an entrance opening arranged at one end of the shaft;

an exit opening arranged at another end of the shaft; and wherein the crate entrance opening and the crate exit opening are aligned with each other on one side of the shaft.

* * * * *